United States Patent [19]

Rolfes

[11] 4,097,418

[45] Jun. 27, 1978

[54] GRANULAR COLORED SPECKLES

[75] Inventor: Thomas Richard Rolfes, Wyoming, Ohio

[73] Assignee: The Procter & Gamble Company, Cincinnati, Ohio

[21] Appl. No.: 758,361

[22] Filed: Jan. 10, 1977

Related U.S. Application Data

[63] Continuation of Ser. No. 619,756, Oct. 6, 1975, abandoned, and a continuation-in-part of Ser. No. 598,523, Jul. 23, 1975, abandoned.

[51] Int. Cl.[2] ..... C11D 3/065; C11D 3/40; C11D 11/00; C11D 17/06

[52] U.S. Cl. ..... 252/531; 23/313 R; 264/117; 252/89 R; 252/109; 252/134; 252/135; 252/140; 252/174; 252/532; 252/539

[58] Field of Search ..... 23/313; 264/117; 252/89, 109, 110, 134, 135, 174, 532, 539, 140, 531

[56] References Cited

U.S. PATENT DOCUMENTS

| | | | |
|---|---|---|---|
| 2,141,589 | 12/1938 | Bishop | 8/77 |
| 2,889,283 | 6/1959 | Tecklenburg | 252/89 |
| 3,035,301 | 5/1962 | Rodis | 264/69 |
| 3,123,565 | 3/1964 | Millsaps | 252/135 |
| 3,529,923 | 9/1970 | Perry | 8/77 |
| 3,544,473 | 12/1970 | Kitchen | 252/99 |
| 3,679,610 | 7/1972 | Sams | 252/529 |
| 3,762,859 | 10/1973 | Wixon | 252/110 X |

FOREIGN PATENT DOCUMENTS

| | | | |
|---|---|---|---|
| 1,248,994 | 10/1971 | United Kingdom | 252/135 |

*Primary Examiner*—Dennis L. Albrecht
*Attorney, Agent, or Firm*—George Galanes; William H. Gould; Thomas H. O'Flaherty

[57] ABSTRACT

A granular colored speckle is provided having non-staining qualities comprising a granular, water-soluble, hydratable, inorganic alkaline salt agglomerated with an anionic surfactant paste as the adhesive agent containing the coloring agent. The granular colored speckle is particularly useful in admixture with white or lightly colored detergent granules to provide a speckled composition.

2 Claims, No Drawings

GRANULAR COLORED SPECKLES

CROSS-REFERENCE TO RELATED APPLICATION

This is a continuation of application Ser. No. 619,756 filed Oct. 6, 1975, now abandoned; and a c-i-p of Ser. No. 598,523, filed July 23, 1975, now abandoned.

BACKGROUND OF THE INVENTION

This invention relates to agglomerated colored speckles for use in admixture with white or lightly colored detergent granules to provide detergent compositions having a distinctive and attractive appearance and which-because of the nature of the agglomerated colored speckles-are non-staining to fabrics in use.

Detergent compositions containing colored speckles are known in the art. The colored speckles can be added to white or lightly colored detergent granules to provide a distinctive and readily recognizable appearance to the detergent composition. For example, Canadian Pat. No. 577,479 issued June 9, 1959, to Britt describes just such a detergent composition containing colored speckles.

Various methods of making granular colored speckles are known in the art. For example, Canadian Pat. No. 577,478 issued June 9, 1959, to Tecklenburg describes a process wherein a portion of a stream of spray dried granular material coming from the spray tower is diverted to a drum, sprayed with a color solution, and then recombined with the main portion with mixing to provide the speckled detergent composition. Another method is that described in U.S. Pat. No. 3,035,301 issued May 22, 1962, to Rodis et al which is an agglomeration process employing a pan agglomerator. Another method is to merely mix two differently colored spray dried granular compositions in the desired proportions.

In addition to providing a distinctive and attractive appearance to a detergent composition, the granular colored speckes should not cause objectionable staining to white fabrics that contact the colored speckles in use. U.S. Pat. No. 3,529,923 issued Sept. 22, 1970, to Perry et al., teaches that granular bluing compositions, containing ultramarine blue as the bluing agent, when used in detergent compositions can cause objectionable staining to fabrics unless there is incorporated in the bluing composition a cationic quaternary ammonium compound. The granular bluing composition was made by spraying sodium tripolyphosphate with an adhering mixture comprised of dextrin, ultramarine blue, dicoconut alkyl methylbenzylammonium chloride and water utilizing a pan agglomerator.

Granular colored speckles to be used in making speckled detergent compositions can, but need not contain a substantive dye or pigment. For example, a blue speckle intended only for distinctive and attractive appearance in a detergent composition can contain phthalocyanine blue. This pigment is generally considered to be non-substantive to fabrics. However, instances of fabric staining by phthalocyanine blue, which stains do not wash out in subsequent laundering, have been observed.

It has now been discovered that non-staining granular colored speckles in agglomerate form can be made by agglomerating a granular, water-soluble, hydratable, inorganic alkaline salt with an anionic surfactant paste as the adhesive agent which contains the dye or pigment. Without wishing to be bound by theory it appears that mixing the dye or pigment with anionic surfactant prior to agglomeration prevents the dye or pigment particles from attaching to each other and then to fabric to form visible stains when dissolving the colored speckles i.e., the anionic surfactant speeds dispersion of the dye or pigment during the dissolution of the colored speckles.

It is an object of this invention to provide granular colored speckles which can be utilized in detergent compositions to provide a distinctive and attractive appearance and which are non-staining in use in the washing of fabrics.

This and other objects of this invention will be apparent from the following description.

SUMMARY

This invention provides a granular colored speckle in agglomerate form having good appearance and low fabric staining potential comprising from about 60 to about 95%, by weight, of a granular, water-soluble, hydratable, inorganic alkaline salt, from about 0.1 to about 10%, by weight, of a coloring agent and from about 5 to about 35%, by weight, of an anionic surfactant paste.

The method of making the granular colored speckles of this invention comprises agglomerating a granular, water-soluble, hydratable, inorganic alkaline salt with from about 5 to about 35%, by weight, of the granular colored speckles, of an anionic surfactant paste having admixed in said paste from about 0.1 to about 10%, by weight, of the granular colored speckles, of a coloring agent.

DETAILED DESCRIPTION OF THE INVENTION

The objects of this invention are achieved by a granular colored speckle containing a granular, water-soluble, hydratable, inorganic alkaline salt, a coloring agent and an anionic surfactant paste. It should be understood that use of the word dye to express the coloring agent is meant to refer to both water-soluble coloring agents or dyes and to water-insoluble coloring agents or pigments. The speckle is in the form of an agglomerate.

The Inorganic Alkaline Salt

The inorganic alkaline salt utilized in this invention is a granular, water-soluble, hydratable salt which is compatible with the other ingredients of the speckle. The usual hydrate is stable against thermal decomposition at room temperature. The function of the granular, water-soluble, hydratable inorganic alkaline salt is to serve as a carrier for the coloring agent. It is a preferred embodiment of this invention to employ sodium tripolyphosphate in the colored speckle which contributes to its overall laundering effectiveness, particularly if it is used to "speckle" detergent compositions. Otherwise, the granular, water-soluble, hydratable, inorganic alkaline salt can be any salt having the desired properties of compatibility and hydrate stability.

Alkali metal tripolyphosphates, e.g., sodium tripolyphosphate, are the preferred inorganic alkaline salts but alkali phosphates, e.g., trisodium phosphate, alkali metal carbonates, e.g., sodium carbonate, alkali metal pyrophosphates, e.g., sodium pyrophosphate, and alkali metal tetraborates, e.g., anhydrous borax, can also be utilized. Corresponding potassium and lithium salts can likewise be used, but sodium salts are preferred. The granular, water-soluble, hydratable inorganic alkaline salt comprises the bulk of the granular colored speckle and will comprise the balance of the speckle after the coloring agent and the anionic detergent paste and any other additives are included. Generally the granular, water-soluble, hydratable, inorganic alkaline salt wil comprise from about 60 to about 95%, preferably from 60 to about 85%, most preferably 65 to about 75%, by weight, of the colored speckle.

The Anionic Surfactant Paste

The anionic surfactant paste is a water-slurry of an alkali metal salt of an organic anionic surfactant. Especially preferred salts are the sodium and potassium salts.

The anionic surfactant of the instant colored speckles can be an organic sulfuric reaction product having in its molecular structure an alkyl group containing from about 8 to 22 carbon atoms and a sulfonic acid or sulfuric acid ester group, or mixtures thereof. (Included in the term "alkyl" is the alkyl portion of acyl groups.) Examples of this group of synthetic surfactants which can be used in the present invention are the alkyl sulfates, especially those obtained by sulfating the higher alcohols ($C_8$–$C_{18}$ carbon atoms) produced from the glycerides of tallow or coconut oil; and alkyl benzene sulfonates, in which the alkyl group contains from about 9 to about 14 carbon atoms, in straight chain or branched chain configuration, e.g., those of the type described in U.S. Pat. Nos. 2,220,099 and 2,477,383, incorporated herein by reference. Linear straight chain alkyl benzene sulfonates in which the average of the alkyl groups is about 13 carbon atoms, abbreviated as $C_{13}$LAS, as well as mixed $C_{11.2(avg.)}$LAS are typically used. $C_{11}$–$C_{14}$ branched chain alkyl benzene sulfonates (ABS), which are excellent sudsers, can also be used.

Other anionic surfactant compounds herein include the alkyl glyceryl ether sulfonates, especially those ethers of higher alcohols derived from tallow and coconut oil; coconut oil fatty acid monoglyceride sulfonates and sulfates; and alkyl phenol ethylene oxide ether sulfates containing about 1 to about 10 units of ethylene oxide per molecule and wherein the alkyl groups contain about 8 to about 12 carbon atoms.

Other useful anionic surfactants herein include the esters of $\alpha$-sulfonated fatty acids containing from about 6 to 20 carbon atoms in the ester group; 2-acyloxyalkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; paraffin sulfonates having 8 to 22 carbon atoms, preferably 12 to 16 carbon atoms in the alkyl group; olefin sulfonates containing from about 12 to 24 carbon atoms in the alkyl group; and $\beta$-alkyloxy alkane sulfonates containing from about 1 to 3 carbon atoms in the alkyl group and from about 8 to 20 carbon atoms in the alkane moiety.

Preferred water-soluble anionic organic surfactants herein include linear alkyl benzene sulfonates containing from about 10 to about 18 carbon atoms in the alkyl group; branched alkyl benzene sulfonates containing from about 10 to about 18 carbon atoms in the alkyl group; the tallow range alkyl sulfates; the coconut range alkyl glyceryl sulfonates; alkyl ether (ethoxylated) sulfates wherein the alkyl moiety contains from about 14 to 18 carbon atoms and wherein the average degree of ethoxylation varies between 1 and 12, especially 3 to 9; the sulfated condensation products of tallow alcohol with from about 3 to 12, especially 6 to 9, moles of ethylene oxide; olefin sulfonates containing from about 14 to 16 carbon atoms; and soaps, as hereinabove defined.

Specific preferred anionic surfactants for use herein include: the linear $C_{10}$–$C_{14}$ alkyl benzene sulfonates (LAS); the branched $C_{10}$ to $C_{14}$ alkyl benzene sulfonates (ABS); coconut alkyl sulfate; tallow alkyl sulfate; the coconut alkyl glyceryl ether sulfonates; the sulfated condensation products of mixed $C_{10}$–$C_{18}$ tallow alcohols with from about 3 to about 14 moles of ethylene oxide; and the mixtures of higher fatty acids containing from 10 to 18 carbon atoms.

It is to be recognized that any of the foregoing anionic surfactants can be used separately herein or as mixtures. Moreover, commercial grades of the surfactants can contain non-interfering components which are processing by-products. For example, commercial $C_{10}$–$C_{14}$ alkaryl sulfonates can comprise alkyl benzene sulfonates, alkyl toluene sulfonates, alkyl napthalene sulfonates and alkyl poly-benzenoid sulfonates. Such materials and mixtures thereof are fully contemplated for use herein.

The anionic surfactant can conveniently be obtained from the sulfation or sulfonation step in detergent manufacturing, neutralized with an aqueous solution of an alkali metal hydroxide or carbonate and employed in this invention as a paste. The anionic surfactant metal salt in this invention provides a dispersion medium for the coloring agents and as an adhesive to aid in agglomerating the said inorganic alkaline salt until the said inorganic alkaline salt picks up moisture and hydrates to form a crisp agglomerated speckle.

As mentioned above, the anionic surfactant is used in paste form, the coloring agent is added and the mixture is sprayed onto the said inorganic alkaline salt. The anionic surfactant paste that is sprayed onto the said inorganic alkaline salt can have the following composition:

| | | |
|---|---|---|
| Anionic surfactant | 20 to 50 | wt. % |
| Water | 45 to 60 | |
| $Na_2SO_4$ | 1 to 25 | |
| Sodium toluene sulfonate | 0 to 10 | |

Generally the anionic surfactant paste will comprise from about 5 to about 35%, preferably from 15 to about 30%, most preferably from 25 to about 30% by weight, of the granular colored speckle.

The Coloring Agent

The coloring agents contemplated for use in this invention are characterized by their ability to provide a distinctive color when sprayed onto a granular, water-soluble, hydratable, inorganic alkaline salt. The coloring agent may be a water-soluble dye or a water-insoluble pigment capable of dispersion in water. It is preferable that the coloring agent does not contain an appreciable percentage of particles having a size larger than 150 $\mu$. Dry particulate coloring agents that pass through a 100 mesh Tyler screen and have less than about 3% by weight of particles that will not pass through a 325 mesh Tyler screen are particularly preferred.

Examples of dye which can be utilized in this invention are: (1) Polar Brilliant Blue GAW 180% sold by Ciba-Geigy S.A., Basel, Switzerland (similar to C.I. ["Color Index"] 61135 - Acid Blue 127), (2) FD&C Blue #1 (C.I. 42090), (3) Rhodamine EM (C.I. 45170), (4)

Pontacyl Light Yellow 36 (similar to C.I. 18820), (5) Polar Brilliant Blue RAW (C.I. 61585 - Acid Blue 80).

Examples of pigments which can be utilized in this invention are: (1) Phthalocyanine Blue (C.I. 74160), (2) Phthalocyanine Green (C.I. 74260), (3) Ultramarine Blue (C.I. 77007 - Pigment Blue 29).

Generally the coloring agent comprises from about 0.1 to about 10%, by weight, of the granular colored speckle. If less than about 0.1%, by weight, is used the desired coloring effect is not achieved and if more than about 10%, by weight, is used then an undesirable coloring level and staining may occur even with the use of the anionic surfactants of this invention. A preferred range of coloring agent of from about 0.2 to about 3% by weight, will yield the best results of this invention.

In addition to the above, the granular colored speckle can contain non-essential, non-interfering optional ingredients to provide improved performance or aesthetic appeal such as enzymes, bleaching agents, antimicrobical agents, corrosion inhibitors and perfume. Such components preferably comprise no more than about 3%, by weight, of the granular colored speckle.

In the method aspect of this invention the coloring agent is mixed with the anionic surfactant paste and then sprayed onto the said inorganic alkaline salt which is allowed to agglomerate and hydrate.

The method of preparing the granular colored speckles is by agglomeration. Generally any means wherein the said inorganic alkaline salt particles are made to tumble around and over themselves while being sprayed with the anionic surfactant paste as the adhesive agent containing the coloring agent are satisfactory. Suitable commonly available apparatus for this purpose include a cement mixer and a pan agglomerator. The pan agglomerator is preferred.

The granular colored speckle of the present in invention is desirably comprised of granules coming within the range of 0.2 millimeters up to about 1.5 millimeters in size. Preferably, the granules should be of a reasonably uniform size averaging about 1 millimeter. A satisfactory particle size distribution can be obtained by having less than 1% be retained on a Tyler 10 mesh screen, about 60% being retained on a 48 Tyler mesh screen and having less than about 10% pass through a 65 Tyler mesh screen.

The granular size distribution should especially be adhered to when the granular colored speckle is to be employed with and distributed throughout a white or lightly colored granular detergent composition. In such an application, it is especially important to be free of fine, powdery materials for the reason that they tend to segregate in a carton and the desired aesthetic appearance would be lost. In addition, fine colored powders, i.e., less than 0.2 millimeters, tend to blend into the background and present a diffused or pastel appearance when employed in detergent compositions. Particle sizes greater than about 1.5 millimeters also tend to detract from the desired distinctive appearance. As a precautionary measure, the fines can be screened out either before coloring or after by using screens of 48 Tyler mesh or even finer.

Even apart from the consideration of employing the granular colored speckle in combination with detergent granules to make speckled detergent compositions, the particle size distribution given above affords best results of imparting a desired visual effect without the risk of an attendant staining problem.

The granular colored speckles can be used to enhance the visual appearance of granular detergent compositions and also to provide a bluing agent so that fabrics washed in solutions of speckled detergent compositions containing the granular colored speckles will acquire a bluing effect. With regard to visual appearance it should be understood that the granular speckled detergent composition can contain speckles of more than one color as desired. For example, a granular speckled detergent composition can contain blue, green and yellow speckles.

When the granular colored speckle is utilized with detergent granules, e.g., a white granular detergent composition, the granular colored speckle should be used in an amount of from 2 up to about 30% by weight of the combined composition; the balance to 100% being the detergent granules. The teachings of the Britt patent, supra, in this regard are incorporated herein by reference. It has been found that with this proportion of granular colored speckles thoroughly mixed with a balance of detergent granules of roughly the same general characteristics of size, density or specific gravity, the mixture is permanent in the sense that the granular colored speckles do not tend to segregate upon handling, jogging and the like. Prefrably, the granular colored speckles of the present invention and the bulk of the detergent granules should have approximately the same screen analysis, i.e., particle size distribution.

The following examples illustrate in detail the manner in which the invention may be practiced. However, the invention is not confined to the specific limitations set forth in the individual examples but rather, to the scope of the appended claims. All amounts and percentages in the specification and claims are by weight unless otherwise indicated.

EXAMPLE I

To 27.75 parts of surfactant paste (containing about 27.0% sodium dodecylbenzene sulfonate having an average of 12 carbons in the branched alkyl chain, 0.5% sodium toluene sulfonate, 17.0% sodium sulfate and 55.5% water) were added 2.25 parts of coloring agents (1.55 parts ultramarine blue, 0.5 parts phthalocyanine blue and 0.2 parts of Polar Brilliant Blue GAW180%). This paste/dye slurry was thoroughly mixed and 30 parts of slurry was sprayed at 130° F. onto 70 parts of granular sodium tripolyphosphate tumbling in a common cement mixer using an air atomizing nozzle system (40/100/120 size sold by the Spraying Systems Co.) and employing 40 psig. air pressure. The initial particle size of the sodium tripolyphosphate was 0% on 10 mesh Tyler, 3.2% thru 10-on 20 mesh, 12% thru 20-on 28 mesh with 2.5% thru 100 mesh. After the spraying operation the mixture was allowed to age for a few minutes to allow the sodium tripolyphosphate to hydrate.

The granular colored speckle obtained from the above process was found to be a crisp and free flowing granule and had a good blue appearance. The particle size of the resultant product was 10% thru 10-on 20 mesh Tyler, 38% thru 20-on 28 mesh, and 0.1% thru 100 mesh showing that agglomeration had taken place.

The granular colored speckle obtained above was compared in staining potential to a granular colored speckle that was made by spraying onto 9 pounds of sodium tripolyphosphate an adhering mixture comprising 3.3 pounds of dextrin glue, 0.4 pounds of phthalocyanine blue and 0.015 pounds of Polar Brilliant Blue GAW180% (The Control Speckle).

The test used to compare the granular colored speckles in staining potential was as follows:

(a) Saturate a fine pore cellulose sponge (size 6JF sold by the Dupont Company) with a 0.5% solution of a white granular detergent composition containing approximately 26% sodium dodecylbenzene sulfonate and 34% sodium tripolyphosphate.

(b) Place the sponge in a reservoir of the 0.5% detergent solution made with water having 9 grains/gallon hardness (3:1Ca:Mg ratio) at 75° F.

(c) Place a 4 × 6 inch cotton muslin swatch on the sponge such that the ends are in the solution, the swatch having been previously washed with a solution of the granular detergent composition in (a).

(d) Place one gram of the granular colored speckle onto the cotton swatch and allow to stand for 4 hours.

(e) Remove the swatch from the sponge and rinse thoroughly, with vigorous rubbing under running water at 75° F.

(f) Allow the swatch to air dry.

(g) Wash the swatch for 10 minutes at 130° F in a 0.5% solution of the detergent composition in (a).

(h) Dry the swatch and grade the staining using a 1–10 scale where 10 represents no staining and 1 is severe staining.

Using the above procedure the granular colored speckle of this invention was graded 8 whereas the Control speckle was graded 7. Thus it was seen that the granular colored speckle of this invention had less staining potential than the control speckle. This advantage for the speckle of this invention will be better appreciated when it is recalled that the "dye" level in the Control granular colored speckle is only about one-fifth the "dye" level of the granular colored speckle of this invention.

When granular trisodium phosphate, sodium carbonate, sodium pyrophosphate and anhydrous borax are substituted for sodium tripolyphosphate on an equal weight basis as the said inorganic alkaline salt of Example I substantially equivalent results are obtained in that granular colored speckles are made which have good appearance and a low staining potential.

EXAMPLE II

Thirty parts of a colored surfactant paste (10.67 parts sodium dodecylbenzene sulfonate, 13.67 parts water, 3.4 parts sodium sulfate and 2.15 parts of ultramarine blue was sprayed onto 70 parts of granular sodium tripolyphosphate in a revolving cement mixer as in Example I. The initial particle size of the granular sodium tripolyphosphate was 0% on 10 mesh Tyler, 2.1% thru 10-on 20 mesh, 6.4% thru 20-on 28, 23.4% thru 28-on 35, and 3.2% thru 100 mesh.

The granular colored speckle obtained was free flowing and had good appearance. The particle size distribution was 10.5% thru 10-on 14 mesh Tyler, 6.8% thru 14-on 28, 17.8% thru 28-on 35, and 0.4% thru 100 mesh. The staining potential was comparable to the speckle of the invention made in Example I.

Substantially equivalent results are obtained i.e., granular colored speckles having good appearance and low staining potential, when the sodium dodecylbenzene sulfonate in the above example is replaced, on an equal weight basis, by sodium linear alkylbenzene sulfonate having 13 carbon atoms in the alkyl chain, the sodium salt of coconut alkyl sulfate, and the sodium salt of the sulfated condensation product of coconut alcohols with an average of 3 moles of ethylene oxide per mole of alcohol.

When phthalocyanine green, FD&C Blue #1 Rhodamine BM, Pontacyl Light Yellow 36 and Polar Brilliant Blue RAW are substituted for the ultramarine blue in the above example substantially equivalent results are obtained in that granular colored speckles are obtained which have good appearance and low staining potential.

EXAMPLE III

Using the procedures of Example I three additional colored speckles were prepared and tested for staining potential. The speckles made and the results observed were as follows:

| Blue Speckle | C-1 | C-2 | C-3 |
|---|---|---|---|
| % Granular Sodium Tripolyphosphate | 85 | 90 | 85 |
| % Surfactant Paste | 12.75 | 7.75 | — |
| % Dextrine Glue | — | — | 12.75 |
| % Coloring agents (as in Ex. I) | 2.25 | 2.25 | 2.25 |
| Particle Size % thru 10-on 20 (Tyler) | 3.6 | 3.6 | 25.7 |
| thru 20-on 28 | 13.1 | 13.0 | 43.9 |
| thru 65 | 9.4 | 4.9 | 1.8 |
| Staining Grade - on cotton | 5 | 3 | 5 |
| on nylon | 6 | 5.5 | 4 |

The granular sodium tripolyphosphate was a fine grade having a particle size 0% on 10 mesh Tyler, 0.02% thru 10-on 20 mesh and 0.26% thru 20-on 28 mesh. As shown by the particle size information given above all three colored speckles exhibit agglomeration of the sodium tripolyphosphate as a result of the making process.

The three blue speckles made were also acceptable when mixed with white base granules to provide a speckled composition having the desired visual impression.

In staining, both speckles (C-1 and C-2) made with surfactant paste exhibited less staining potential than the speckles agglomerated with dextrine on nylon fabric. On cotton fabric the dextrine glue-agglomerated speckles were equal to the 12.75% surfactant paste-agglomerated speckles and better than the 7.75% surfactant paste-agglomerated speckles in staining potential.

What is claimed is:

1. The method of making a low- or non-staining colored speckle which comprises agglomerating from 60 to about 85%, by weight of the granular colored speckle, of a granular, water-soluble, hydratable inorganic alkaline salt selected from the group consisting of sodium tripolyphosphate, sodium pyrophosphate, sodium orthophosphate, and mixtures thereof, with from about 15 to about 35% by weight of the granular colored speckle, of an aqueous anionic surfactant paste comprising from about 20 to about 50%, by weight, of an anionic surfactant selected from the group consisting of sodium alkylbenzene sulfonates having 10 to 14 carbons in the alkyl chain, sodium coconut alkyl sulfate, sodium tallow alkyl sulfate, the sodium salt of the sulfated condensation product of $C_{10}$ to $C_{18}$ alcohols having an average of 3 moles of ethylene oxide per mole of alcohol, and mixtures thereof, and having admixed in said paste from about 0.5 to about 10%, by weight of the granular colored speckle, of a coloring agent selected from the group consisting of phthalocyanine blue, phthalocyanine green, ultramarine blue, Polar Brilliant Blue, Rhodamine BM, Pontacyl Light Yellow 36 and mixtures thereof.

2. A granular colored speckle in agglomerate form made by the process of claim 1.

* * * * *